US007628827B2

(12) United States Patent
Sugita et al.

(10) Patent No.: US 7,628,827 B2
(45) Date of Patent: Dec. 8, 2009

(54) APPARATUS AND METHOD FOR PRODUCING SOLID FUEL USING LOW-GRADE COAL AS RAW MATERIAL

(75) Inventors: Satoru Sugita, Takasago (JP); Tetsuya Deguchi, Takasago (JP); Takuo Shigehisa, Takasago (JP); Shinichi Katsushima, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 852 days.

(21) Appl. No.: 11/082,863

(22) Filed: Mar. 18, 2005

(65) Prior Publication Data

US 2005/0204615 A1 Sep. 22, 2005

(30) Foreign Application Priority Data

Mar. 18, 2004 (JP) ..... 2004-078644

(51) Int. Cl.
*C10L 5/00* (2006.01)
*B65G 53/00* (2006.01)
*B01F 5/10* (2006.01)

(52) U.S. Cl. ..... 44/629; 366/136; 159/47.1; 406/197

(58) Field of Classification Search ..... 366/136; 159/47.1
See application file for complete search history.

(56) References Cited

U.S. PATENT DOCUMENTS

| | | | | | |
|---|---|---|---|---|---|
| 3,988,236 | A | * | 10/1976 | Albright et al. | 208/408 |
| 4,309,192 | A | | 1/1982 | Kubo et al. | |
| 4,559,060 | A | | 12/1985 | Muroi et al. | |
| 4,624,807 | A | | 11/1986 | Miyauchi et al. | |
| 4,671,800 | A | | 6/1987 | Meyer et al. | |
| 4,671,801 | A | | 6/1987 | Burgess et al. | |
| 4,765,781 | A | * | 8/1988 | Wilks et al. | 406/197 |
| 4,869,727 | A | * | 9/1989 | Rigby | 44/572 |
| 4,908,167 | A | | 3/1990 | Beckmann et al. | |
| 4,969,928 | A | | 11/1990 | Wen et al. | |
| 5,162,050 | A | | 11/1992 | Knudson et al. | |
| 5,474,653 | A | * | 12/1995 | Bostjancic | 159/47.1 |
| 5,503,646 | A | | 4/1996 | McKenny et al. | |
| 5,554,201 | A | | 9/1996 | Yagaki et al. | |
| 5,556,436 | A | | 9/1996 | Yagaki et al. | |
| 6,039,470 | A | * | 3/2000 | Conwell | 366/137 |
| 2002/0057625 | A1 | * | 5/2002 | Russell et al. | 366/136 |

FOREIGN PATENT DOCUMENTS

| | | |
|---|---|---|
| JP | 56-30461 | 3/1981 |
| JP | 57-187393 | 11/1982 |
| JP | 10-158666 | 6/1998 |

* cited by examiner

*Primary Examiner*—Glenn A Caldarola
*Assistant Examiner*—Chantel Ferguson-Graham
(74) *Attorney, Agent, or Firm*—Oblon, Spivak, McClelland, Maier & Neustadt, L.L.P.

(57) ABSTRACT

An apparatus for producing solid fuel includes a passage for introducing a supernatant in a mixing tank into a portion between the bottom of the mixing tank and a first slurry pump of a first slurry circulating passage using a third pump, and a passage for introducing a supernatant in an evaporator into a portion between the bottom of the evaporator and a second slurry pump of a second slurry circulating passage using a fourth pump. A method for producing a solid fuel includes introducing a supernatant in a mixing tank into a first slurry circulating passage, for washing a portion where coal deposits, and introducing a supernatant in an evaporator into a second slurry circulating passage, for washing a portion where coal deposits.

8 Claims, 3 Drawing Sheets

APPARATUS AND METHOD FOR PRODUCING SOLID FUEL USING LOW-GRADE COAL AS RAW MATERIAL

BACKGROUND OF THE INVENTION

1. Field of the Invention

The present invention belongs to a technical field relating to an apparatus and method for producing solid fuel using low-grade coal as a raw material.

2. Description of the Related Art

With respect to a technique for producing solid fuel using low-grade coal as a raw material, a known method for producing solid fuel is that disclosed in Japanese Unexamined Patent Application Publication No. 7-233383. The method for producing solid fuel disclosed in this document comprises mixing an oil mixture containing heavy oil and solvent oil with porous coal to prepare a raw material slurry, heating the slurry to progress dehydration and fill the pores of the porous coal with the oil mixture containing the heavy oil and the solvent oil, and then subjecting the slurry to liquid/solid separation. The porous carbon corresponds to low-grade coal.

The method for producing solid fuel disclosed in the above document can produce dehydrated solid fuel having increased calorie value, low spontaneous combustibility, and excellent transport and storage quality.

Namely, the porous coal (low-grade coal) contains a large quantity of water, and thus transport of the porous coal requires transport of water, thereby increasing transport cost. Therefore, the transport quality is degraded, and the calorie value is decreased due to the high water content. Therefore, it is desired to dehydrate the porous coal. However, the dehydration by a usual drying method has the danger that a spontaneous combustion accident occurs due to oxygen adsorption and oxidation reaction at active sites present in the pores of the dehydrated porous coal.

On the other hand, in the method for producing solid fuel disclosed in the above-described document, the raw material slurry (mixture containing the porous coal and the mixed oil containing the heavy oil and the solvent oil) is heated to evaporate the moisture in the pores of the porous coal and coat the pores with the oil mixture containing the heavy oil and finally fill the pores with the oil mixture, preferentially the heavy oil. As a result, the oxygen adsorption and oxidation reaction at the active sites present in the pores are suppressed, thereby suppressing spontaneous combustion. Furthermore, the coal is dehydrated by heating, and the calorie thereof is increased by the dehydration and oil filling in the pores, thereby producing dehydrated solid fuel having increased calorie value, low spontaneous combustibility and excellent transport and storage quality.

With respect to an apparatus for producing the above-mentioned solid fuel, the above document discloses an apparatus for producing solid fuel comprising a mixing tank for mixing the oil mixture containing the heavy oil and the solvent oil with the porous coal to prepare the raw material slurry, an evaporator for removing water vapor by heating the raw material slurry, and a liquid/solid separator for liquid/solid separation of the heated slurry. The porous coal corresponds to low-grade coal.

The apparatus for producing solid fuel disclosed in the above-described document is a basic apparatus for producing the above-described solid fuel. When the apparatus is used, in order to maintain a slurry state in the mixing tank and the evaporator, the slurry is stirred with a stirrer, and, at the same time, the slurry is circulated by a slurry pump to cause a turbulent state for preventing coal deposition and maintaining the slurry state. The slurry is circulated through a slurry circulating passage having the slurry pump provided therein. In the mixing tank, the slurry is circulated by introducing the slurry to the top of the mixing tank from the bottom of the mixing tank through the slurry circulating passage thereof. In the evaporator, the slurry is circulated by introducing the slurry to the top of the evaporator from the bottom of the evaporator through the slurry circulating passage thereof.

The slurry state is maintained by stirring and circulating the slurry, but when the stirring and circulation of the slurry are stopped by a power failure, an apparatus failure, or the like, the solid (coal) contained in the slurry settles to cause blocking due to coal deposits at the bottom of the mixing tank, a portion (for example, a portion between the bottom of the mixing tank and the slurry pump) of the slurry circulating passage of the mixing tank, the bottom of the evaporator, a portion (for example, a portion between the evaporator and the slurry pump) of the slurry circulating passage of the evaporator, and the like.

Due to this blocking, the apparatus cannot be restarted. In order to permit restarting, therefore, the apparatus is disassembled (for example, the pipes constituting the slurry circulating passage are removed) to remove the slurry, and the insides of the pipes, the mixing tank, and the evaporator are washed with oil.

In this case, the slurry in the evaporator contains moisture at high temperature and high pressure, and thus the slurry escapes when the vessel (evaporator) is opened, thereby requiring clean up. Therefore, the slurry is usually allowed to cool to a temperature close to room temperature. However, the cooling requires several days because the evaporator is covered with a heat insulator, and thus the operation must be stopped for a long period of time, thereby requiring a long time for restarting the operation.

SUMMARY OF THE INVENTION

The present invention has been achieved in consideration of the above-mentioned situation, and an object of the present invention is to provide an apparatus and method for producing solid fuel using low-grade coal as a raw material, in which when stirring and slurry circulation are stopped by a power failure or the like to cause blocking due to coal deposition, a portion where coal deposits can be washed to remove blocking without disassembling of the apparatus and the need for cooling the slurry.

The inventors carried out intensive research for achieving the object, and as a result the present invention was completed. The object can be achieved by the present invention.

In order to achieve the object, the present invention relates an apparatus and method for producing solid fuel using low-grade coal as a raw material, the apparatus and method having the following construction.

In a first aspect of the present invention, an apparatus for producing solid fuel comprises a mixing tank for mixing an oil mixture containing heavy oil and solvent oil with low-grade coal to prepare a raw material slurry, a first slurry circulating passage for introducing the raw material slurry to the top of the mixing tank from the bottom thereof through a first slurry pump, an evaporator for removing water vapor by heating the raw material slurry introduced from a raw material slurry supply passage, which branches from the first slurry circulating passage, a second slurry circulating passage for introducing the slurry to the top of the evaporator from the bottom thereof through a second slurry pump, and a liquid/solid separator for liquid/solid separation of the slurry introduced from a slurry supply passage, which branches from the second slurry circulating passage. The apparatus further comprises a passage for introducing a supernatant produced by settling of the solid of the slurry in the mixing tank into a portion between the bottom of the mixing tank and the first slurry pump of the first slurry circulating passage through a third pump.

In a second aspect of the present invention, an apparatus for producing solid fuel comprises a mixing tank for mixing an oil mixture containing heavy oil and solvent oil with low-grade coal to prepare a raw material slurry, a first slurry circulating passage for introducing the raw material slurry to the top of the mixing tank from the bottom thereof through a first slurry pump, an evaporator for removing water vapor by heating the raw material slurry introduced from a raw material slurry supply passage, which branches from the first slurry circulating passage, a second slurry circulating passage for introducing the slurry to the top of the evaporator from the bottom thereof through a second slurry pump, and a liquid/solid separator for liquid/solid separation of the slurry introduced from a slurry supply passage, which branches from the second slurry circulating passage. The apparatus further comprises a passage for introducing a supernatant produced by settling of the solid of the slurry in the evaporator into a portion between the bottom of the evaporator and the second slurry pump of the second slurry circulating passage through a fourth pump.

In a third aspect of the present invention, an apparatus for producing solid fuel comprises a mixing tank for mixing an oil mixture containing heavy oil and solvent oil with low-grade coal to prepare a raw material slurry, a first slurry circulating passage for introducing the raw material slurry to the top of the mixing tank from the bottom thereof through a first slurry pump, an evaporator for removing water vapor by heating the raw material slurry introduced from a raw material slurry supply passage, which branches from the first slurry circulating passage, a second slurry circulating passage for introducing the slurry to the top of the evaporator from the bottom thereof through a second slurry pump, and a liquid/solid separator for liquid/solid separation of the slurry introduced from a slurry supply passage, which branches from the second slurry circulating passage. The apparatus further comprises a passage for introducing a supernatant produced by settling of the solid of the slurry in the mixing tank into a portion between the bottom of the mixing tank and the first slurry pump of the first slurry circulating passage through a third pump, and a passage for introducing a supernatant produced by settling of the solid of the slurry in the evaporator into a portion between the bottom of the evaporator and the second slurry pump of the second slurry circulating passage through a fourth pump.

In order to remove the solid in the circulating passages, the apparatus preferably further comprises a passage for introducing the supernatant in the mixing tank into a portion between the top of the mixing tank and the first slurry pump of the first slurry circulating passage through the third pump, and a passage for introducing the supernatant in the evaporator into a portion between the top of the evaporator and the second slurry pump of the second slurry circulating passage through the fourth pump. In order to wash the pump, the apparatus preferably further comprises a passage for introducing oil for washing into the first slurry pump or a passage for introducing oil for washing into the second slurry pump.

In a fourth aspect of the present invention, a method for producing solid fuel comprises mixing an oil mixture containing heavy oil and solvent oil with low-grade coal in a mixing tank to prepare a raw material slurry and introducing the raw material slurry to the top of the mixing tank from the bottom thereof through a first slurry circulating passage, dehydrating the raw material slurry by heating in an evaporator and introducing the slurry to the top of the evaporator from the bottom thereof through a second slurry circulating passage, and subjecting the dehydrated slurry to a liquid/solid separation. The method further comprises introducing a supernatant into the first slurry circulating passage to wash a portion where the solid deposits, the supernatant being produced by settling of the solid of the slurry at the bottom of the mixing tank and/or in the first slurry circulating passage.

In a fifth aspect of the present invention, a method for producing solid fuel comprises mixing an oil mixture containing heavy oil and solvent oil with low-grade coal in a mixing tank to prepare a raw material slurry and introducing the raw material slurry to the top of the mixing tank from the bottom thereof through a first slurry circulating passage, dehydrating the raw material slurry by heating in an evaporator and introducing the slurry to the top of the evaporator from the bottom thereof through a second slurry circulating passage, and subjecting the dehydrated slurry to liquid/solid separation. The method further comprises introducing a supernatant into the second slurry circulating passage to wash a portion where the solid deposits, the supernatant being produced by settling of the solid of the slurry at the bottom of the evaporator and/or in the second slurry circulating passage.

When stirring and slurry circulation are stopped by a power failure or the like to cause blocking due to coal deposits, the apparatus for producing solid fuel according to the present invention is capable of removing the blocking by washing a portion where the coal deposits, without disassembling the apparatus and the need for cooling the slurry. When stirring and slurry circulation are stopped by a power breakdown or the like to cause blocking due to coal deposits, the method for producing solid fuel according to the present invention is capable of removing the blocking by washing a portion where the coal deposits, without disassembling the apparatus and the need for cooling the slurry.

DESCRIPTION OF THE PREFERRED EMBODIMENTS

Figure 1:
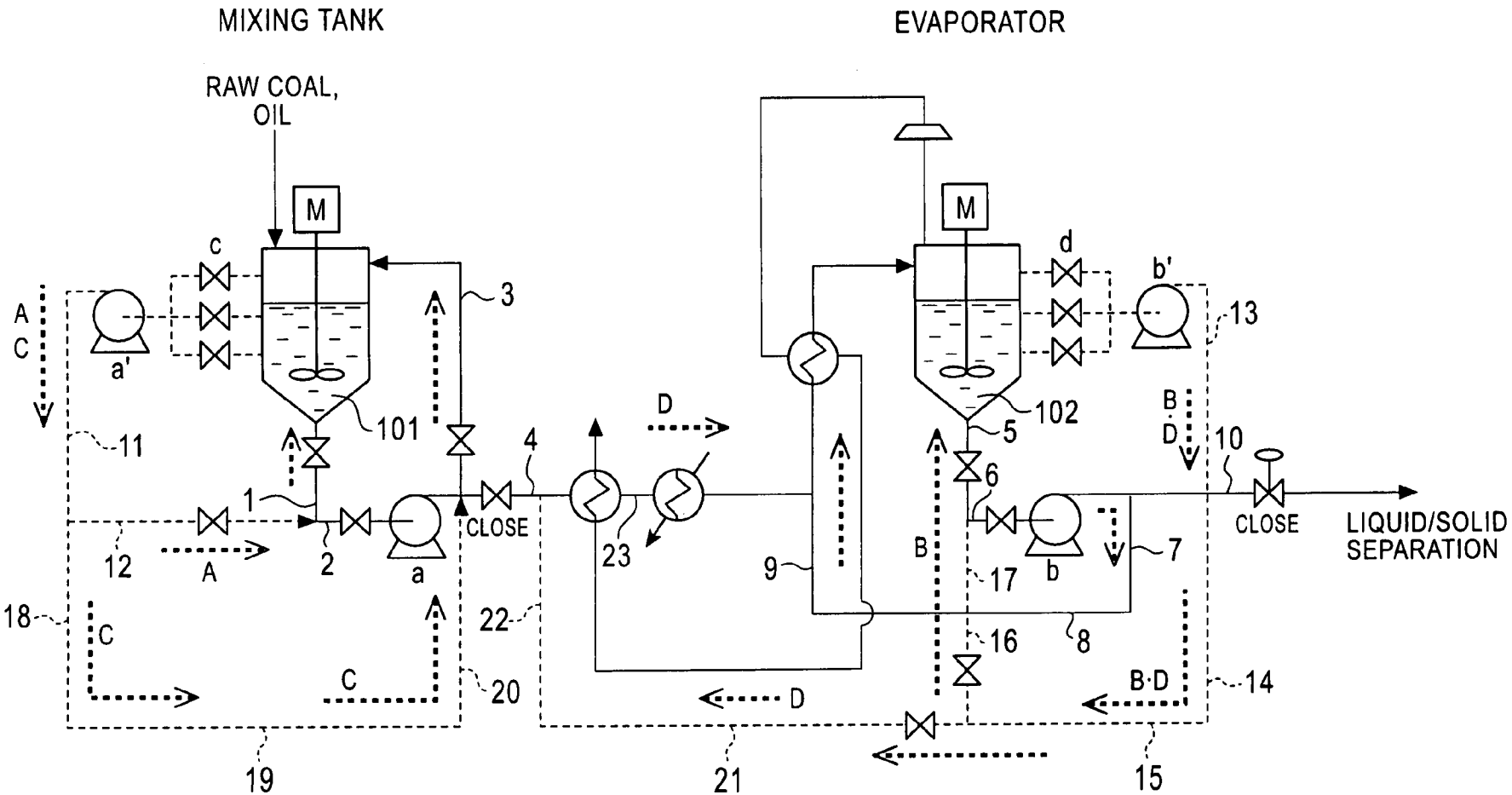
FIG. 1 is a schematic drawing showing the outlines of an apparatus and method according to an embodiment of the present invention.

An apparatus for producing solid fuel according to the present invention comprises a mixing tank for mixing an oil mixture containing heavy oil and solvent oil with low-grade coal to prepare a raw material slurry, a first slurry circulating passage for introducing the raw material slurry to the top of the mixing tank from the bottom thereof through a first slurry pump, an evaporator for removing steam by heating the raw material slurry introduced from a raw material slurry supply passage branching from the first slurry circulating passage, a second slurry circulating passage for introducing the slurry to the top of the evaporator from the bottom thereof through a second slurry pump, and a liquid/solid separator for liquid/solid separation of the slurry introduced from a slurry supply passage, which branches from the second slurry circulating passage. The apparatus for producing solid fuel further comprises a passage for introducing a supernatant, which occurs due to settling of the solid in the slurry in the mixing tank, to a portion between the bottom of the mixing tank and the first slurry pump of the first slurry circulating passage through a third pump, and a passage for introducing a supernatant, which occurs due to settling of the solid in the slurry in the evaporator, to a portion between the bottom of the evaporator and the second slurry pump of the second slurry circulating passage through a fourth pump.

When stirring and slurry circulation are stopped by a power failure, an apparatus failure, or the like in the apparatus, the solid (coal) in the slurry easily settles and deposits to cause blocking at the bottom of the mixing tank, a portion of the first slurry circulating passage below the mixing tank (a portion between the bottom of the mixing tank and the first slurry pump in the first slurry circulating passage), the bottom of the evaporator, and a portion of the second slurry circulating passage below the evaporator (a portion between the bottom of the evaporator and the second slurry pump in the second slurry circulating passage).

When stirring and slurry circulation are stopped, as described above, a supernatant phase occurs due to settling of the solid (coal) in the slurry in the mixing tank. On the other hand, in the evaporator, a supernatant phase occurs due to settling of the solid in the slurry. The term "supernatant" means an upper liquid phase produced by settling of a solid, the liquid phase not containing the solid or containing the solid at a low concentration. Namely, the supernatant is not limited to a liquid phase not containing a solid, but includes a liquid phase containing a small amount of solid, i.e., having a low solid content (this applies to the description below).

As described above, the apparatus comprises the passage (referred to as "passage A" hereinafter) for introducing the supernatant, which occurs due to settling of the solid in the slurry in the mixing tank, to a portion between the bottom of the mixing tank and the first slurry pump of the first slurry circulating passage through the third pump, and the passage (referred to as "passage B" hereinafter) for introducing the supernatant, which occurs due to settling of the solid in the slurry in the evaporator, to a portion between the bottom of the evaporator and the second slurry pump of the second slurry circulating passage through the fourth pump. For example, in an apparatus shown in FIG. 1 (first embodiment of the present invention), the passage A is denoted by reference character A (including a passage 11 (having a third pump a') and a passage 12), and the passage B is denoted by reference character B (including a passage 13 (having a fourth pump b') to a passage 17).

In the above-described apparatus, when stirring and slurry circulation are stopped to cause blocking due to settling of the solid (coal) in the slurry at the bottom of the mixing tank and a portion of the first slurry circulating passage below the mixing tank (a portion between the bottom of the mixing tank and the first slurry pump in the first slurry circulating passage), the supernatant in the mixing tank is introduced into a portion (for example, a passage 1 in the apparatus shown in FIG. 1) between the bottom of the mixing tank and the first slurry pump of the first slurry circulating passage through the passage A using the third pump a'. Then, the supernatant is flowed into the bottom of the mixing tank and the inside thereof to wash out the solid (coal) deposits. Namely, the portion where the coal deposits can be washed to remove the blocking. In this case, disassembling of the apparatus and cooling of the slurry are not required.

When stirring and slurry circulation are stopped to cause blocking due to settling of the solid (coal) in the slurry at the bottom of the evaporator and a portion of the second slurry circulating passage below the evaporator (a portion between the bottom of the evaporator and the second slurry pump in the second slurry circulating passage), the supernatant in the evaporator is introduced into a portion (for example, a passage 6 in the apparatus shown in FIG. 1) between the bottom of the evaporator and the second slurry pump of the second slurry circulating passage through the passage B using the fourth pump b'. Also, the supernatant is flowed into the bottom of the evaporator and the inside thereof to wash out the solid (coal) deposits. Namely, the portion where the coal deposits can be washed to remove the blocking. In this case, disassembling of the apparatus and cooling of the slurry are not required.

When stirring and slurry circulation are stopped by a power failure or the like to cause blocking due to the coal deposits at the bottom of the mixing tank, a portion of the first slurry circulating passage below the mixing tank, the bottom of the evaporator, and a portion of the second slurry circulating passage below the evaporator (blocking most easily occurs in all of these portions due to coal deposits), therefore, the apparatus is capable of washing out the coal deposits to remove the blocking without disassembling the apparatus and requiring cooling of the slurry. As a result, the time taken from the stop of the operation to restarting can be shortened.

In the apparatus, when stirring and slurry circulation are stopped, the coal in the slurry also settles at a portion between the top of the mixing tank and the first slurry pump in the first slurry circulating passage and a portion between the top of the evaporator and the second slurry pump in the second slurry circulating passage. In some cases, the coal deposits to cause blocking at these portions depending on the time elapsed from the stop of stirring and slurry circulation.

In order to remove the blocking at the portions, it is preferable to provide a passage (referred to as a "passage C" hereinafter) for introducing the supernatant in the mixing tank to a portion between the top of the mixing tank and the first slurry pump in the first slurry circulating passage through the third pump, and a passage (referred to as a "passage D" hereinafter) for introducing the supernatant in the evaporator to a portion between the top of the evaporator and the second slurry pump in the second slurry circulating passage through the fourth pump. For example, in the apparatus shown in FIG. 1 (first embodiment of the present invention), the passage C is denoted by reference character C (including a passage 11 (having the third pump a') and passages 18 to 20), and the passage D is denoted by reference character D (including a passage 13 (having the fourth pump b'), passages 14 and 15, and passages 21 to 23).

When the coal deposits to cause blocking at a portion between the top of the mixing tank and the first slurry pump in the first slurry circulating passage, the supernatant in the mixing tank is introduced into a portion (for example, a passage 3 or 4 in the apparatus shown in FIG. 1) between the top of the mixing tank and the first slurry pump of the first slurry circulating passage through the passage C using the third pump a'. Also, the supernatant is flowed toward the top of the mixing tank to wash out the coal deposits. Namely, the portion where the coal deposits can be washed to remove the blocking. In this case, disassembling of the apparatus and cooling of the slurry are not required.

When the coal deposits to cause blocking at a portion between the top of the evaporator and the second slurry pump in the second slurry circulating passage, the supernatant in the evaporator is introduced into a portion (for example, a passage 9 in the apparatus shown in FIG. 1) between the top of the evaporator and the second slurry pump of the second slurry circulating passage through the passage D using the fourth pump b'. Also, the supernatant is flowed toward the top of the evaporator to wash out the coal deposits. Namely, the portion where the coal deposits can be washed to remove the blocking. In this case, disassembling of the apparatus and cooling of the slurry are not required.

When the coal deposits to cause blocking at a portion between the top of the mixing tank and the first slurry pump in the first slurry circulating passage, the supernatant in the mixing tank can be introduced into a portion (for example, a passage 2 in the apparatus shown in FIG. 1) between the bottom of the mixing tank and the first slurry pump in the first slurry circulating passage through the passage A using the third pump. The supernatant can be flowed toward the top of the mixing tank through the first slurry pump to wash the portion where the coal deposits and remove the blocking.

When the coal deposits to cause blocking at a portion between the top of the evaporator and the second slurry pump in the second slurry circulating passage, the supernatant in the evaporator can be introduced into a portion (for example, a passage 6 in the apparatus shown in FIG. 1) between the bottom of the evaporator and the second slurry pump in the second slurry circulating passage through the passage B using the fourth pump. The supernatant can be flowed toward the top of the evaporator through the second slurry pump to wash the portion where the coal deposits and remove the blocking.

As described above, the apparatus for producing solid fuel according to the present invention comprises the mixing tank for mixing the oil mixture containing heavy oil and solvent oil with the low-grade coal to prepare the raw material slurry, the first slurry circulating passage for introducing the raw material slurry to the top of the mixing tank from the bottom thereof through the first slurry pump, the evaporator for removing water vapor by heating the raw material slurry introduced from the raw material slurry supply passage branching from the first slurry circulating passage, the second slurry circulating passage for introducing the slurry to the top of the evaporator from the bottom thereof through the second slurry pump, and the liquid/solid separator for liquid/solid separation of the slurry introduced from the slurry supply passage, which branches from the second slurry circulating passage. The apparatus for producing solid fuel further comprises a passage for introducing oil for washing into the first slurry pump, a passage for introducing oil for washing into the second slurry pump, a passage (referred to as a "passage E" hereinafter) for introducing the supernatant, which is produced by settling of the solid in the slurry in the mixing tank, into a portion between the top of the mixing tank and the first slurry pump of the first slurry circulating passage, and a passage (referred to as a "passage F" hereinafter) for introducing the supernatant, which is produced by settling of the solid in the slurry in the evaporator, into a portion between the top of the evaporator and the second slurry pump of the second slurry circulating passage. For example, in the apparatus shown in FIG. 2 (second embodiment of the present invention) which will be described below, the passage E is denoted by reference character E (including passages 68 to 70), and the passage F is denoted by reference character F (including passages 63 and 63').

In the apparatus, when stirring and slurry circulation are stopped to cause blocking due to deposition of the solid (coal) in the slurry at the bottom of the mixing tank and a portion of the first slurry circulating passage below the mixing tank (a portion between the bottom of the mixing tank and the first slurry pump in the first slurry circulating passage), the oil for washing is introduced into the first slurry pump through the passage for introducing oil for washing into the first slurry pump, for washing the inside of the first slurry pump. Then, the first slurry pump is operated to introduce the supernatant in the mixing tank into a portion (for example, a passage 53 or 54 in the apparatus shown in FIG. 2) between the top of the mixing tank and the first slurry pump of the first slurry circulating passage through the passage E, and the supernatant is flowed into the mixing tank through the bottom of the mixing tank using the first slurry pump. As a result, the coal deposits at the bottom of the mixing tank and a portion of the first slurry circulating passage below the mixing tank can be washed out. Namely, the portions where the coal deposits can be washed to remove the blocking. In this case, disassembling of the apparatus and cooling of the slurry are not required. When the first slurry pump is operated in the same manner as in the use of the first slurry circulating passage, the liquid cannot be flowed in the above-described direction. In order to flow the liquid in the above-described direction, some consideration is required. For example, when pipes are further disposed around the pump as shown in FIG. 3, the liquid can be flowed in the above-described direction. Namely, as shown in FIG. 3, when the pump is operated with valves a" and b" open and valves c" and d" closed, the liquid flows through a passage 201, the valve a", the pump P, the valve b", and a passage 202 in that order. On the other hand, when the pump is operated with the valves a" and b" closed and the valves c" and d" open, the liquid flows through the passage 202, a passage 203, the pump P, a passage 204, the valve c", and the passage 201 in that order in the direction (reverse flow direction) reverse to the normal direction. Therefore, the liquid can be flowed in the above-described direction (for example, the passages 68, 69, 70, 51 in that order in the apparatus shown in FIG. 2 which will be described below).

When stirring and slurry circulation are stopped cause blocking due to deposition of the solid (coal) in the slurry at the bottom of the evaporator and a portion of the second slurry circulating passage below the evaporator (a portion between the bottom of the evaporator and the second slurry pump in the second slurry circulating passage), the oil for washing is introduced into the second slurry pump through the passage for introducing oil for washing into the second slurry pump, for washing the inside of the second slurry pump. Then, the second slurry pump is operated to introduce the supernatant in the evaporator into a portion (for example, the passage 63' in the apparatus shown in FIG. 2) between the top of the evaporator and the second slurry pump of the second slurry circulating passage through the passage F, and the supernatant is flowed into the evaporator through the bottom of the evaporator using the second slurry pump. As a result, the coal deposits at the bottom of the evaporator and a portion of the second slurry circulating passage below the evaporator can be washed out. Namely, the portions where the coal deposits can be washed to remove the blocking. In this case, disassembling of the apparatus and cooling of the slurry are not required. When the second slurry pump is operated in the same manner as in the use of the second slurry circulating passage, the liquid cannot be flowed in the above-described direction. In order to flow the liquid in the above-described direction, for example, the pipes may be further disposed around the pump as shown in FIG. 3, and the valves may be closed and opened as described above.

Therefore, when stirring and slurry circulation are stopped by a power failure or the like to cause blocking due to coal deposits at the bottom of the mixing tank, a portion of the first slurry circulating passage below the mixing tank, the bottom of the evaporator, and a portion of the second slurry circulating passage below the evaporator (blocking most easily occurs in all of these portions due to coal deposition), the apparatus is capable of removing the blocking by washing the portions where the coal deposits, without disassembling the apparatus and without requiring cooling of the slurry. Therefore, the time required from the stop of the operation to restarting can be shortened.

When blocking occurs due to coal deposits between the top of the mixing tank and the first slurry pump in the first slurry circulating passage, or when blocking occurs due to coal deposits between the top of the evaporator and the second slurry pump in the second slurry circulating passage, depending upon the time elapsed from the stop of stirring and slurry circulation, the blocking can be removed by washing the portions where the coal deposits, as described above (removal of the blocking), and then washing as described below.

Namely, in the case of the mixing tank, the first slurry pump is operated to circulate the slurry so that the slurry is introduced to the top of the mixing tank from the bottom thereof through the first slurry circulating passage, and thereby the blocking can be removed by washing the portion where the coal deposits. In the case of the evaporator, the second slurry pump is operated to circulate the slurry so that the slurry is introduced to the top of the evaporator from the bottom thereof through the second slurry circulating passage, and thereby the blocking can be removed by washing the portion where the coal deposits. In either of the cases, disassembling of the apparatus and cooling of the slurry are not required.

Furthermore, a passage (referred to as "passage G" hereinafter) is provided for introducing the supernatant in the mixing tank into a portion between the bottom of the mixing tank and the first slurry pump in the first slurry circulating passage. In this case, when the coal deposits to case blocking between the top of the mixing tank and the first slurry pump in the first slurry circulating passage, the first slurry pump is operated to introduce the supernatant in the mixing tank into a portion (for example, the passage 51 in the apparatus shown in FIG. 2) between the bottom of the mixing tank and the first slurry pump in the first slurry circulating passage through the passage G, and the supernatant is flowed toward the top of the mixing tank through the first slurry pump. As a result, the blocking can be removed by washing the portion where the coal deposits. For example, in the apparatus shown in FIG. 2 which will be described below, the passage G is denoted by reference character G (including the passage 68).

Furthermore, a passage (referred to as "passage H" hereinafter) is provided for introducing the supernatant in the evaporator into a portion between the bottom of the evaporator and the second slurry pump in the second slurry circulating passage. In this case, when the coal deposits to cause blocking between the top of the evaporator and the second slurry pump b of the second slurry circulating passage, the second slurry pump is operated to introduce the supernatant in the evaporator into a portion (for example, the passage 56 in the apparatus shown in FIG. 2) between the bottom of the evaporator and the second slurry pump in the second slurry circulating passage through the passage H, and the supernatant is flowed toward the top of the evaporator through the second slurry pump. As a result, the blocking can be removed by washing the portion where the coal deposits. For example, in the apparatus shown in FIG. 2 which will be described below, the passage H is denoted by reference character H (including the passage 63).

In the present invention, as described above, the term "low-grade coal" means coal containing a large quantity of water and desired to be dehydrated. Examples of the low-grade coal include brown coal, lignite, and subbituminous coal. Examples of the brown coal include Victorian coal, North Dakota coal, and Bengal coal. Examples of the subbituminous coal include West Banko coal and Binungan coal. The low-grade coal is not limited to these examples, and the low-grade coal of the present invention includes any coal containing a large quantity of water and desired to be dehydrated.

The term "heavy oil" means heavy oil or oil containing heavy oil which shows substantially no vapor pressure even at, for example, 400° C., such as vacuum residual oil.

The mixing tank is not particularly limited, and various types can be used. However, an axial-type stirrer is generally used. The evaporator is not particularly limited, and various types can be used. For example, a flash evaporator, a coil-type evaporator, a forced-circulation-type vertical tube evaporator, or the like can be used. However, a forced-circulation-type evaporator with a heat exchanger is generally used.

The liquid/solid separator is not particularly limited, and various types can be used. For example, a centrifugal separator, a compressor, a sedimentation tank, a filter, or the like can be used. However, a centrifugal separator is generally used.

The slurry is dehydrated by the evaporator, and the slurry (dehydrated slurry) is subjected to liquid/solid separation by the liquid/solid separator to produce solid and liquid contents. The solid content can be cooled and used as a powdery solid fuel, or cooled and then briquetted to solid fuel briquette.

As described above, the method for producing solid fuel of the present invention comprises mixing the oil mixture containing heavy oil and solvent oil with the low-grade coal in the mixing tank to prepare the raw material slurry and introducing the raw material slurry to the top of the mixing tank from the bottom thereof through the first slurry circulating passage, dehydrating the raw material slurry by heating in the evaporator and introducing the slurry to the top of the evaporator from the bottom thereof through the second slurry circulating passage, and subjecting the dehydrated slurry to liquid/solid separation. The method further comprises introducing the supernatant into the first slurry circulating passage to wash a portion where the solid deposits, the supernatant being produced by settling of the solid in the slurry in the mixing tank when the solid settles and deposits at the bottom of the mixing tank and/or in the first slurry circulating passage, and introducing the supernatant into the second slurry circulating passage to wash a portion where the solid deposits, the supernatant being produced by settling of the solid in the slurry in the evaporator when the solid in the slurry settles and deposits at the bottom of the evaporator and/or in the second slurry circulating passage. In this method, the supernatant is introduced as described above, for washing the portion where the solid deposits. The washing can be performed without disassembling the apparatus and requiring cooling of the slurry.

When stirring and slurry circulation are stopped by a power failure or the like to cause blocking due to coal deposits at the bottom of the mixing tank, a portion of the first slurry circulating passage below the mixing tank, the bottom of the evaporator, and a portion of the second slurry circulating passage below the evaporator (blocking most easily occurs in all of these portions due to coal deposits), therefore, the method for producing solid fuel of the present invention is capable of removing the blocking by washing the portions where the coal deposits, without disassembling the apparatus and requiring cooling of the slurry. As a result, the time required from the stop of the operation to restarting can be shortened.

Figure 2:
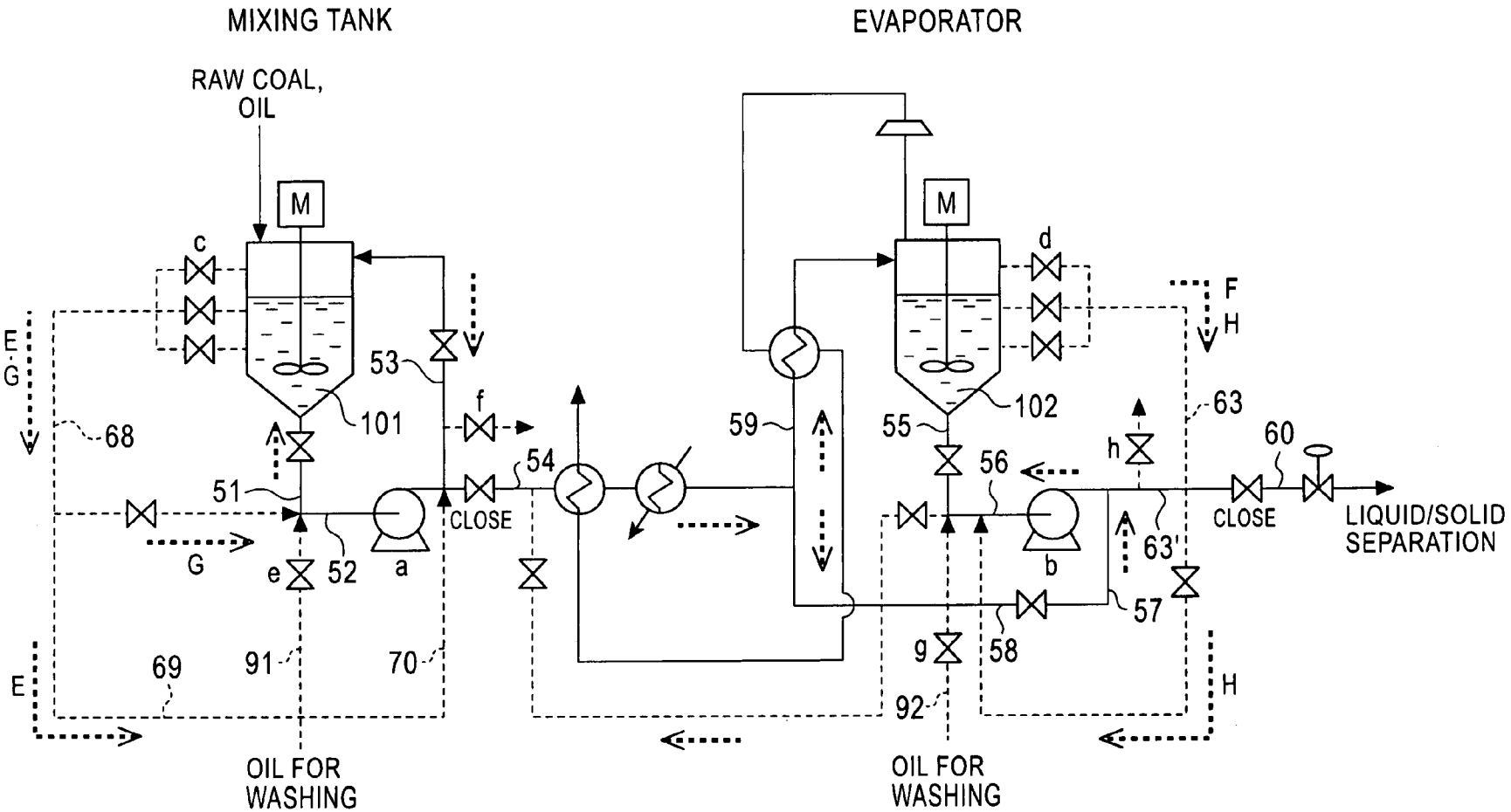
FIG. 2 is a schematic drawing showing the outlines of an apparatus and method according to another embodiment of the present invention.
Figure 3:
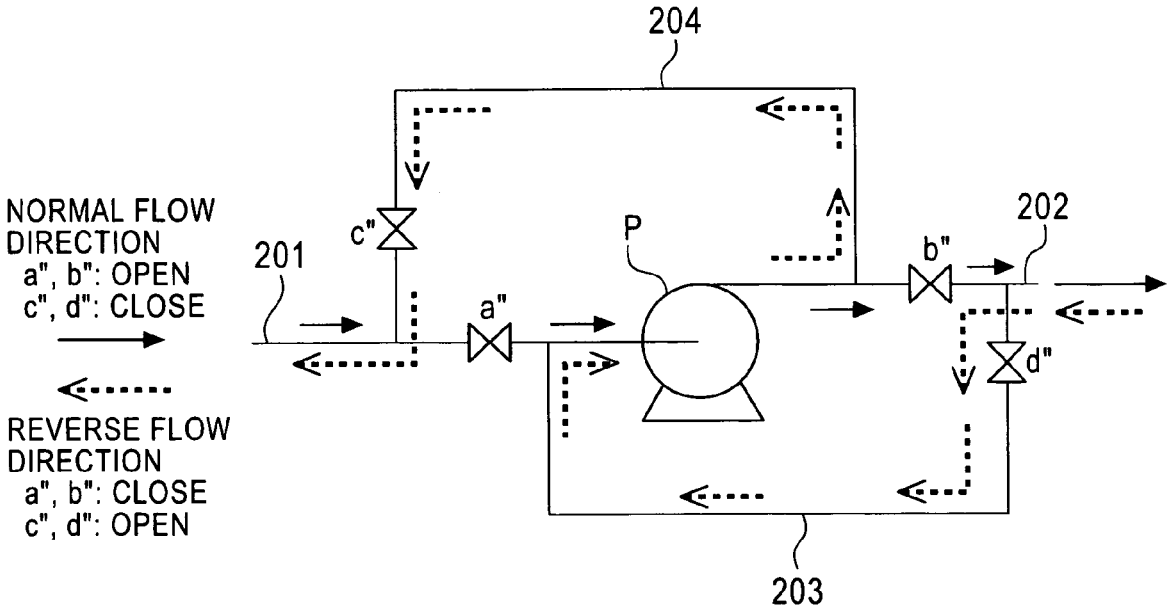
FIG. 3 is a schematic drawing showing a pipe structure around a pump for permitting liquid flows in a normal flow direction and a reverse flow direction.

The first and second embodiments of the present invention are shown in FIGS. 1 and 2, respectively.

The apparatus shown in FIG. 1 comprises a mixing tank for mixing an oil mixture containing heavy oil and solvent oil with low-grade coal to prepare a raw material slurry, a first slurry circulating passage (including passages 1 to 3 having a slurry pump a) for introducing the raw material slurry to the top of the mixing tank from the bottom thereof through the first slurry pump a, an evaporator for removing water vapor by heating the raw material slurry introduced from the raw material supply passage 4 branching from the first slurry circulating passage, a second slurry circulating passage (including passages 5 to 9 having a second slurry pump b) for introducing the slurry to the top of the evaporator from the bottom thereof through the second slurry pump b, and a liquid/solid separator for liquid/solid separation of the slurry introduced from a slurry supply passage 10, which branches from the second slurry circulating passage. The apparatus further comprises a passage A [including a passage 11 (having a third pump a') and a passage 12] for introducing a supernatant, which is produced by settling of the solid in the slurry in the mixing tank, into a portion (passage 1) between the bottom of the mixing tank and the first slurry pump a of the first slurry circulating passage through the third pump a', and a passage B [including a passage 13 (having a fourth pump b') to a passage 17] for introducing the supernatant, which is produced by settling of the solid in the slurry in the evaporator, into a portion (a passage 5 or 6) between the bottom of the evaporator and the second slurry pump b of the second slurry circulating passage through the fourth pump b'.

The apparatus further comprises a passage C [comprising the passage 11 (having the third pump a') and passages 18 to 20] for introducing the supernatant in the mixing tank into a portion (the passage 4 or 3) between the top of the mixing tank and the first slurry pump a of the first slurry circulating passage through the third pump a', and a passage D [comprising the passage 13 (having the fourth pump b'), a passage 14, a passage 15, and passages 21 to 23] for introducing the supernatant in the evaporator into a portion (a passage 9) between the top of the evaporator and the second slurry pump b of the second slurry circulating passage through the fourth pump b'.

In the apparatus, when stirring and slurry circulation are stopped to cause blocking due to deposition of the solid (coal) in the slurry at the bottom 101 of the mixing tank and in a portion 1 or 2 (between the bottom 101 of the mixing tank and the first slurry pump a in the first slurry circulating passage) of the first slurry circulating passage below the mixing tank, one which can suck the supernatant from the mixing tank is selected from valves c and opened, and the third pump a' is operated to introduce the supernatant in the mixing tank into a portion (passage 1) between the bottom 101 of the mixing tank and the first slurry pump a of the first slurry circulating passage using the third pump a' through the passage A [including the passage 11 (having the third pump a') and the passage 12]. Also, the supernatant is flowed into the mixing tank through the bottom 101 thereof from the passage 1. As a result, the solid (coal) deposits can be washed out. Namely, the portion where the coal deposits can be washed to remove the blocking. In this case, disassembling of the apparatus and cooling of the slurry are not required.

When stirring and slurry circulation are stopped to cause blocking due to deposition of the solid (coal) in the slurry at the bottom 102 of the evaporator and in the portion (between the bottom 102 of the evaporator and the second slurry pump b in the second slurry circulating passage) of the second slurry circulating passage below the evaporator, one which can suck the supernatant from the evaporator is selected from valves d and opened, and the fourth pump b' is operated to introduce the supernatant in the evaporator into a portion (passage 6 or 5) between the bottom 102 of the evaporator and the second slurry pump b of the second slurry circulating passage using the fourth pump b' through the passage B [including the passage 13 (having the fourth pump b') to the passage 17]. Also, the supernatant is flowed into the evaporator through the bottom 102 thereof from the passage 5. As a result, the solid (coal) deposits can be washed out. Namely, the portion where the coal deposits can be washed to remove the blocking. In this case, disassembling of the apparatus and cooling of the slurry are not required.

When the coal deposits to cause blocking between the top of the mixing tank and the first slurry pump a of the first slurry circulating passage, one which can suck the supernatant from the mixing tank is selected from the valves c and opened, and the third pump a' is operated to introduce the supernatant in the mixing tank into a portion (passage 4 or 3) between the top of the mixing tank the first slurry pump a of the first slurry circulating passage using the third pump a' through the passage C [including the passage 11 (having the third pump a') and the passages 18 to 20]. Also, the supernatant is flowed into the mixing tank through the top thereof from the passage 3. As a result, the solid (coal) deposits can be washed out. Namely, the portion where the coal deposits can be washed to remove the blocking. In this case, disassembling of the apparatus and cooling of the slurry are not required.

When the coal deposits to cause blocking between the top of the evaporator and the second slurry pump b of the second slurry circulating passage, the supernatant in the evaporator is introduced into a portion (passage 9) between the bottom of the evaporator and the second slurry pump b of the second slurry circulating passage using the fourth pump b' through the passage D [including the passage 13 (having the fourth pump b'), the passage 14, passage 15, and the passages 21 to 23]. Also, the supernatant is flowed into the evaporator through the top thereof from the passage 9. As a result, the solid (coal) deposits can be washed out. Namely, the portion where the coal deposits can be washed to remove the blocking. In this case, disassembling of the apparatus and cooling of the slurry are not required.

The apparatus shown in FIG. 2 comprises a mixing tank for mixing an oil mixture containing heavy oil and solvent oil with low-grade coal to prepare a raw material slurry, a first slurry circulating passage (including passages 51 to 53 having a first slurry pump a) for introducing the raw material slurry to the top of the mixing tank from the bottom thereof through the first slurry pump a, an evaporator for removing water vapor by heating the raw material slurry introduced from a raw material supply passage 54 branching from the first slurry circulating passage, a second slurry circulating passage (including passages 55 to 59 having a second slurry pump b) for introducing the slurry to the top of the evaporator from the bottom thereof through the second slurry pump b, and a liquid/solid separator (not shown) for liquid/solid separation of the slurry introduced from a slurry supply passage 60, which branches from the second slurry circulating passage. The apparatus further comprises a passage 91 for introducing oil for washing into the first slurry pump a, a passage 92 for introducing oil for washing into the second slurry pump b, a passage E (including passages 68 to 70) for introducing the supernatant, which is produced by settling of the solid in the slurry in the mixing tank, into a portion (passage 53 or 54) between the top of the mixing tank and the first slurry pump a of the first slurry circulating passage, and a passage F (including passages 63 and 63') for introducing the supernatant, which is produced by settling of the solid in the slurry in the evaporator, into a portion (passage 63') between the top of the evaporator and the second slurry pump b of the second slurry circulating passage.

In the apparatus, when stirring and slurry circulation are stopped to cause blocking due to deposition of the solid (coal)

in the slurry at the bottom 101 of the mixing tank and in a portion 51 or 52 (between the bottom 101 of the mixing tank and the first slurry pump a in the first slurry circulating passage) of the first slurry circulating passage below the mixing tank, the oil for washing is first introduced into the first slurry pump a through the passage 91 to wash the inside of the first slurry pump a. When the inside of the first slurry pump a is washed, the passage 52 is also washed, thereby causing a state in which the first slurry pump a can be operated by rotation. Next, a valve which can suck the supernatant from the mixing tank is selected from valves c and opened, and the first slurry pump a is operated to introduce the supernatant in the mixing tank into a portion (passage 53 or 54) between the top of the mixing tank and the first slurry pump a of the first slurry circulating passage through the passage E (including the passages 68 to 70). Also, the supernatant is flowed into the mixing tank through the bottom 101 thereof from the passages 51 and 52 through the first slurry pump a. As a result, the solid (coal) deposits at the bottom 101 of the mixing tank and in the first slurry circulating passage below the mixing tank can be washed out. Namely, the portion where the coal deposits can be washed to remove the blocking. In this case, disassembling of the apparatus and cooling of the slurry are not required. When the first slurry pump is operated in the same manner as in the use of the first slurry circulating passage, the liquid cannot be flowed in the above-described direction. In order to flow the liquid in the above-described direction, some consideration is required. For example, when pipes are further disposed around the pump as shown in FIG. 3, the liquid can be flowed in the above-described direction. Namely, as shown in FIG. 3, when the pump is operated with the valves a" and b" closed and the valves c" and d" open, the liquid flows through the passage 202, the passage 203, the pump P, the passage 204, the valve c", and the passage 201 in that order in the direction (reverse flow direction) reverse to the normal direction. Therefore, the liquid can be flowed in the above-described direction (for example, the passages 68, 69, 70, 51 in that order).

When stirring and slurry circulation are stopped to cause blocking due to deposition of the solid (coal) in the slurry at the bottom 102 of the evaporator and in a portion (between the bottom 102 of the evaporator and the second slurry pump b in the second slurry circulating passage) of the second slurry circulating passage below the evaporator, the washing oil is first introduced into the second slurry pump b through the passage 92 to wash the inside of the second slurry pump b. When the inside of the second slurry pump b is washed, the passage 56 is also washed, thereby causing a state in which the second slurry pump b can be operated by rotation. Next, a valve which can suck the supernatant from the evaporator is selected from valves d and opened, and the second pump b is operated to introduce the supernatant in the evaporator into a portion (passage 63') between the top of the evaporator and the second slurry pump b of the second slurry circulating passage through the passage F (including the passage 63 and the passage 63'), and the supernatant is flowed into the evaporator through the bottom 102 thereof from the passage 55 and 56 using the second slurry pump b. As a result, the solid (coal) deposits at the bottom 102 of the evaporator and in the second slurry circulating passage below the evaporator can be washed out. Namely, the portion where the coal deposits can be washed to remove the blocking. In this case, disassembling of the apparatus and cooling of the slurry are not required. When the second slurry pump is operated in the same manner as in the use of the second slurry circulating passage, the liquid cannot be flowed in the above-described direction. In order to flow the liquid in the above-described direction, for example, pipes are further disposed around the pump as shown in FIG. 3, and valves are opened and closed as described above.

When the coal deposits to cause blocking between the top of the mixing tank and the first slurry pump a of the first slurry circulating passage, the above-described washing (i.e., removal of the blocking at the bottom 101 of the mixing tank and in the first slurry circulating passage below the mixing tank) is first performed. Then, the first pump a is operated to circulate the slurry from the bottom of the mixing tank to the top thereof through the first slurry circulating passage using the first slurry pump a. As a result, the coal deposits can be washed out. Namely, the portion where the coal deposits can be washed to remove the blocking. In this case, disassembling of the apparatus and cooling of the slurry are not required.

When the coal deposits to cause blocking between the top of the evaporator and the second slurry pump b of the second slurry circulating passage, the above-described washing (i.e., removal of the blocking at the bottom 102 of the evaporator and in the first slurry circulating passage below the evaporator) is first performed. Then, the second slurry pump b is operated to circulate the slurry from the bottom of the evaporator to the top thereof through the second slurry circulating passage using the second slurry pump b. As a result, the solid (coal) deposits can be washed out. Namely, the portion where the coal deposits can be washed to remove the blocking. In this case, disassembling of the apparatus and cooling of the slurry are not required.

In the apparatus shown in each of FIGS. 1 and 2, the blocking is removed by washing as described above, and then the first slurry pump a is operated to circulate the slurry through the first slurry circulating passage for a while, for stabilizing the slurry. At the same time, the second slurry pump b is operated to circulate the slurry through the second slurry circulating passage, for stabilizing the slurry.

After the slurry is stabilized as described above, the operation is restarted. In this operation, the slurry (dehydrated slurry) dehydrated by the evaporator is introduced into the liquid/solid separator (not shown) through a slurry supply passage 10 in the apparatus shown in FIG. 1 or a slurry supply passage 60 in the apparatus shown in FIG. 2, and the slurry is subjected to liquid/solid separation to produce solid and liquid contents. The solid content is dried in a final drying part to recover the oil remaining in the solid, so that the solid can be used as powdery solid fuel. Alternatively, the solid is briquetted after drying in the final drying part and used as solid fuel briquette.

What is claimed is:

1. An apparatus for producing solid fuel comprising:

a mixing tank for mixing an oil mixture containing heavy oil and solvent oil with low-grade coal to prepare a raw material slurry;

a first slurry circulating passage for introducing the raw material slurry to the top of the mixing tank from the bottom thereof through a first slurry pump;

an evaporator for removing water vapor by heating the raw material slurry introduced from a raw material slurry supply passage, which branches from the first slurry circulating passage;

a second slurry circulating passage for introducing the slurry to the top of the evaporator from the bottom thereof through a second slurry pump;

a liquid/solid separator for liquid/solid separation of the slurry introduced from a slurry supply passage, which branches from the second slurry circulating passage; and a passage for introducing a supernatant produced by settling of the solid of the slurry in the mixing tank through a third pump into a portion of the first slurry circulating passage between the bottom of the mixing tank and the outlet of the first slurry pump, to wash a portion where the solid deposits.

2. An apparatus for producing solid fuel comprising:

a mixing tank for mixing an oil mixture containing heavy oil and solvent oil with low-grade coal to prepare a raw material slurry;

a first slurry circulating passage for introducing the raw material slurry to the top of the mixing tank from the bottom thereof through a first slurry pump;

an evaporator for removing water vapor by heating the raw material slurry introduced from a raw material slurry supply passage, which branches from the first slurry circulating passage;

a second slurry circulating passage for introducing the slurry to the top of the evaporator from the bottom thereof through a second slurry pump;

a liquid/solid separator for liquid/solid separation of the slurry introduced from a slurry supply passage, which branches from the second slurry circulating passage; and a passage for introducing a supernatant produced by settling of the solid of the slurry in the evaporator through a fourth pump into a portion of the second slurry circulating passage between the bottom of the evaporator and the outlet of the second slurry pump, to wash a portion where the solid deposits.

3. An apparatus for producing solid fuel comprising:

a mixing tank for mixing an oil mixture containing heavy oil and solvent oil with low-grade coal to prepare a raw material slurry;

a first slurry circulating passage for introducing the raw material slurry to the top of the mixing tank from the bottom thereof through a first slurry pump;

an evaporator for removing water vapor by heating the raw material slurry introduced from a raw material slurry supply passage, which branches from the first slurry circulating passage;

a second slurry circulating passage for introducing the slurry to the top of the evaporator from the bottom thereof through a second slurry pump;

a liquid/solid separator for liquid/solid separation of the slurry introduced from a slurry supply passage, which branches from the second slurry circulating passage;

a passage for introducing a supernatant produced by settling of the solid of the slurry in the mixing tank through a third pump into a portion of the first slurry circulating passage between the bottom of the mixing tank and the outlet of the first slurry pump, to wash a portion where the solid deposits; and a passage for introducing a supernatant produced by settling of the solid of the slurry in the evaporator through a fourth pump into a portion of the second slurry circulating passage between the bottom of the evaporator and the outlet of the second slurry pump, to wash a portion where the solid deposits.

4. The apparatus for producing solid fuel according to claim 3, further comprising a passage for introducing the supernatant in the mixing tank into a portion between the top of the mixing tank and the first slurry pump of the first slurry circulating passage through the third pump, and a passage for introducing the supernatant in the evaporator into a portion between the top of the evaporator and the second slurry pump of the second slurry circulating passage through the fourth pump.

5. The apparatus for producing solid fuel according to claim 1, further comprising a passage for introducing oil for washing into the first slurry pump.

6. The apparatus for producing solid fuel according to claim 1, further comprising a passage for introducing oil for washing into the second slurry pump.

7. A method for producing solid fuel, comprising the steps of:

mixing an oil mixture containing heavy oil and solvent oil with low-grade coal in a mixing tank to prepare a raw material slurry and introducing the raw material slurry to the top of the mixing tank from the bottom thereof through a first slurry circulating passage;

dehydrating the raw material slurry by heating in an evaporator and introducing the slurry to the top of the evaporator from the bottom thereof through a second slurry circulating passage;

subjecting the dehydrated slurry to liquid/solid separation; and introducing a supernatant into the first slurry circulating passage to wash a portion where the solid deposits, the supernatant being produced by settling of the solid of the slurry at the bottom of the mixing tank and/or in the first slurry circulating passage.

8. A method for producing solid fuel, comprising the steps of:

mixing an oil mixture containing heavy oil and solvent oil with low-grade coal in a mixing tank to prepare a raw material slurry and introducing the raw material slurry to top of the mixing tank from the bottom thereof through a first slurry circulating passage;

dehydrating the raw material slurry by heating in an evaporator and introducing the slurry to the top of the evaporator from the bottom thereof through a second slurry circulating passage;

subjecting the dehydrated slurry to liquid/solid separation; and introducing a supernatant into the second slurry circulating passage to wash a portion where the solid deposits, the supernatant being produced by settling of the solid of the slurry at the bottom of the evaporator and/or in the second slurry circulating passage.

* * * * *